US011310621B2

(12) United States Patent
Abe et al.

(10) Patent No.: US 11,310,621 B2
(45) Date of Patent: Apr. 19, 2022

(54) SIGNAL PROCESSING DEVICE AND SIGNAL PROCESSING METHOD FOR PERFORMING SOUND LOCALIZATION PROCESSING

(71) Applicant: SOCIONEXT INC., Kanagawa (JP)

(72) Inventors: Kazutaka Abe, Yokohama (JP); Shuji Miyasaka, Yokohama (JP); Katsumi Kobayashi, Yokohama (JP); Yoshitaka Mizuno, Yokohama (JP)

(73) Assignee: SOCIONEXT INC., Kanagawa (JP)

( * ) Notice: Subject to any disclaimer, the term of this patent is extended or adjusted under 35 U.S.C. 154(b) by 0 days.

(21) Appl. No.: 16/884,806

(22) Filed: May 27, 2020

(65) Prior Publication Data

US 2020/0288264 A1 Sep. 10, 2020

Related U.S. Application Data

(63) Continuation of application No. PCT/JP2017/043369, filed on Dec. 1, 2017.

(51) Int. Cl.

| | |
|---|---|
| ***H04S 7/00*** | (2006.01) |
| ***H04R 3/04*** | (2006.01) |
| ***H04R 3/12*** | (2006.01) |
| ***H04R 5/04*** | (2006.01) |

(52) U.S. Cl.

CPC ..... *H04S 7/307* (2013.01); *H04R 3/04* (2013.01); *H04R 3/12* (2013.01); *H04R 5/04* (2013.01); *H04S 7/303* (2013.01)

(58) Field of Classification Search

None

See application file for complete search history.

(56) References Cited

U.S. PATENT DOCUMENTS 5,844,993 A * 12/1998 Iida ..... H04S 3/00 381/18
6,804,358 B1 * 10/2004 Kawano ..... H04S 1/002 381/17

(Continued)

FOREIGN PATENT DOCUMENTS

CN 106303836 A 1/2017
CN 106797525 A 5/2017

(Continued)

OTHER PUBLICATIONS

English machine translation of JP3059191B2 (Year: 2000).*

(Continued)

*Primary Examiner* — James K Mooney
(74) *Attorney, Agent, or Firm* — McDermott Will & Emery LLP

(57) ABSTRACT

A signal processing device includes one or more filter processors that perform sound localization processing of an input acoustic signal and generate output signals; a coefficient setter that sets, for the filter processors, a plurality of filter coefficients for use in the filter processors; an output data selector that selects, out of the output signals subjected to the sound localization processing by the filter processors, output signals to be output to a left speaker and a right speaker; a time measurer that monitors a time for switching the output signals; and a controller that causes the output data selector to select the output signals in accordance with the time for switching the output signals. The plurality of filter coefficients include filter coefficients generated under a plurality of hearing conditions.

12 Claims, 14 Drawing Sheets

(56) References Cited

U.S. PATENT DOCUMENTS

| | | | | |
|---|---|---|---|---|
| 2001/0005824 | A1 | 6/2001 | Kato et al. | |
| 2008/0219454 | A1* | 9/2008 | Iida | H04S 3/00 381/17 |
| 2009/0043411 | A1 | 2/2009 | Yamada et al. | |
| 2009/0141903 | A1* | 6/2009 | Watanabe | H04S 7/302 381/17 |
| 2012/0328108 | A1 | 12/2012 | Enamito et al. | |
| 2017/0251323 | A1 | 8/2017 | Jo et al. | |
| 2017/0359467 | A1* | 12/2017 | Norris | H04S 7/304 |

FOREIGN PATENT DOCUMENTS

| | | | |
|---|---|---|---|
| EP | 0762804 | A2 | 3/1997 |
| JP | H04-030700 | A | 2/1992 |
| JP | 3059191 | B2 * | 7/2000 |
| JP | 2001-186600 | A | 7/2001 |
| JP | 2008-113118 | A | 5/2008 |
| JP | 2009-044263 | A | 2/2009 |
| JP | 2016-015759 | A | 1/2016 |
| WO | WO2017/158338 | A1 * | 9/2017 |

OTHER PUBLICATIONS

International Search Report and Written Opinion, dated Feb. 13, 2018 in International Application No. PCT/JP2017/043369; with partial English translation.

Chinese Office Action dated Dec. 23, 2020, issued in Chinese Patent Application No. 201780097230.6; with partial English translation.

Extended European Search Report dated Jun. 14, 2021 issued in the corresponding European Patent Application No. 17933807.4.

* cited by examiner

SIGNAL PROCESSING DEVICE AND SIGNAL PROCESSING METHOD FOR PERFORMING SOUND LOCALIZATION PROCESSING

CROSS REFERENCE TO RELATED APPLICATION

This is a continuation application of PCT Patent Application No. PCT/JP2017/043369 filed on Dec. 1, 2017, designating the United States of America. The entire disclosure of the above-identified application, including the specification, drawings and claims is incorporated herein by reference in its entirety.

FIELD

The present disclosure relates to a signal processing device and a signal processing method.

BACKGROUND

In recent years, a method of controlling a sound in view of the difference between both ear positions of a hearer is known as a technique of reproducing an acoustic signal output from a speaker to give a hearer realistic feeling (see e.g., PTL 1 and NPL 1). For example, a sound control filter is used to calculate the transfer functions from right and left speakers to both ear positions, thereby controlling the sound. The use of the sound control filter allows localization of the sound indicated by the input acoustic signal to any place and causes the hearer to hear the sound with desired sound control effects.

CITATION LIST

Patent Literature

[PTL 1] Japanese Patent No. 5944567

Non Patent Literature

[NPL 1] Spatial Hearing, Jens Blauert, Masayuki Morimoto, Toshiyuki Goto, Kajima Publishing

SUMMARY

Technical Problem

The transfer functions described above are calculated in advance in view of the distance from the right and left speakers to both the ears of the hearer. In the background art, if the hearer moves, the transfer functions in the position after the movement are thus different from those calculated in advance. It is thus anticipated that no expected sound control effect is obtained, if the hearer moves at a long distance or the transfer functions from the reproducing speakers to both the ear positions of the hearer largely change under the influence of the reproduction environment.

It is an objective of the present disclosure to provide a signal processing device and a signal processing method that give a hearer sound control effects, even if the hearing position of the hearer changes.

Solution to Problem

In order to achieve the objective, a signal processing device according to an aspect of the present disclosure is for controlling sound localization. The signal processing device includes: one or more filter processors that perform sound localization processing of an input acoustic signal and generate output signals; a coefficient setter that sets, for the one or more filter processors, a plurality of filter coefficients for use in the one or more filter processors; an output data selector that selects, out of the output signals subjected to the sound localization processing by the one or more filter processors, an output signal to be output to a speaker; a time measurer that monitors a time for switching the output signals; and a controller that causes the output data selector to select the output signal in accordance with the time for switching the output signals. The plurality of filter coefficients include filter coefficients generated under a plurality of hearing conditions.

With this configuration, the sound control filters designed under different hearing conditions emit sounds. Accordingly, the device gives the hearer sound control effects, even if the hearing position of the hearer changes.

The plurality of hearing conditions may include at least information on a hearing position to which a hearer is likely to move.

With this configuration, the sound control filters designed in the hearing position, to which the hearer may move, emit sounds. Accordingly, the device gives the hearer sound control effects, even if the hearing position changes.

The output data selector may include one or more gain adjusters that adjust gains of the output signals subjected to the sound localization processing to select the output signal to be output to the speaker.

The speaker may include a first speaker and a second speaker in positions different from each other. The output data selector may include: a first adder that adds, out of the output signals whose gains are adjusted, an output signal to be output through the first speaker; and a second adder that adds, out of the output signals whose gains are adjusted, an output signal to be output through the second speaker.

The signal processing device may further include: an auxiliary information input that inputs auxiliary information on two ear positions or a seated position of the hearer for selecting a range of the plurality of filter coefficients set by the coefficient setter; an auxiliary information analyzer that analyzes the auxiliary information input; and a coefficient range selector that selects the range of the plurality of filter coefficients set by the coefficient setter based on a result of analysis by the auxiliary information analyzer.

With this configuration, the input auxiliary information limits the filter processor to be set. Accordingly, the signal processing device more easily gives the hearer sound control effects.

The auxiliary information input may input, as one of the plurality of filter coefficients, a position of a seat on which the hearer is seated.

This configuration allows the use of the information on the position of the seat on which the hearer is seated, to select the range of the filter coefficients. Accordingly, the device easily gives the hearer sound control effects.

The auxiliary information input may input, as the plurality of filter coefficients, image information including the auxiliary information on the two ear positions.

This configuration allows the use of the image information to select the range of the filter coefficients. Accordingly, the device easily gives the hearer sound control effects.

The signal processing device may further include: an acoustic signal analyzer that analyzes the input acoustic signal and inputs the time for switching to the output data selector.

This configuration allows the analysis of the acoustic signal and the control of the timing for switching the output data. The device properly gives the hearer sound control effects when generating the acoustic signal to be recognized by the hearer.

The acoustic signal analyzer may include: a power detector that detects a power of the input acoustic signal; and a determiner that determines whether the power of the input acoustic signal is greater than or equal to a threshold.

In order to achieve the objective, a signal processing method according to the present disclosure controls sound localization. The signal processing method includes: filtering, by one or more filter processors, an input acoustic signal through sound localization and generating output signals; setting, by a coefficient setter, for the one or more filter processors, a plurality of filter coefficients for use in the one or more filter processors; selecting, by a data selection processor, out of the output signals subjected to the sound localization processing by the one or more filter processors, an output signal to be output to a speaker; monitoring, by a time measurer, a time for switching the output signals; and causing, by a controller, the data selection processor to select the output signal in accordance with the time for switching the output signals. The plurality of filter coefficients include filter coefficients generated under a plurality of hearing conditions.

With this configuration, the sound control filters designed under different hearing conditions emits sounds. Accordingly, the device gives the hearer sound control effects, even if the hearing position of the hearer changes.

The signal processing method may further include: obtaining auxiliary information; and analyzing, by an auxiliary information analyzer, the auxiliary information, and selecting a coefficient range of the plurality of filter coefficients.

This configuration allows the selection of the filter coefficients based on the auxiliary information such as the position of the hearer supposed in advance. This reduces the use of the filter coefficients that provide less sound localization control effects and thus facilitates sound localization control.

The signal processing method may further include: detecting, by the acoustic signal analyzer, a power of the input acoustic signal. In the causing, the controller may cause the data selection processor to select the output signal based on the power detected of the input acoustic signal.

This configuration gives the hearer sound control effects and causes the hearer to recognize the acoustic signal in the period when the auditory effective acoustic signal is generated or, if no auditory effective acoustic signal is generated, when the time for switching/selecting the output data has elapsed.

Advantageous Effects

The present invention provides a signal processing device and a signal processing method that give a hearer sound control effects, even if the hearing position of the hearer changes.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENTS

[Underlying Knowledge Forming Basis of the Present Disclosure]

First, the background art and the objective of the background art will be described in more detail for easier understanding of the present disclosure.

Figure 15A:
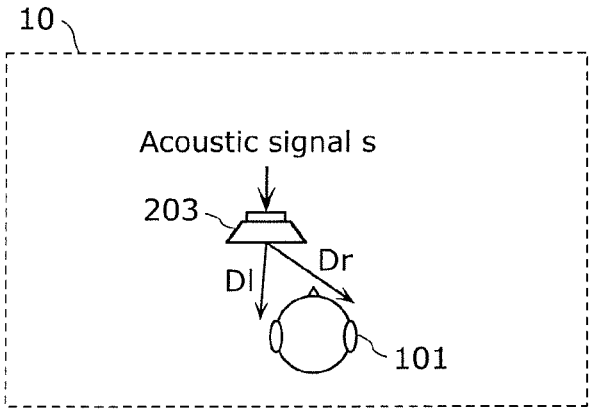
FIG. 15A Prior art
FIG. 15A is a schematic diagram showing a positional relationship, between a hearer and a speaker, meeting desired hearing conditions in a sound control method according to the background art.
Figure 15B:
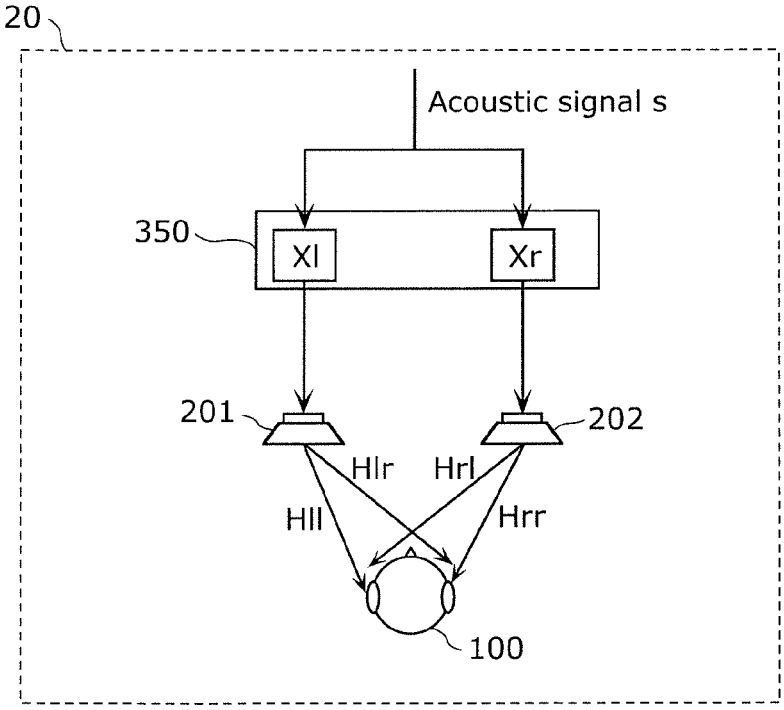
FIG. 15B Prior art
FIG. 15B is a schematic diagram showing an actual positional relationship between the hearer and speakers in reproducing an acoustic signal in the sound control method according to the background art.

FIG. 15A is a schematic diagram showing a positional relationship, between a hearer and a speaker, meeting desired hearing conditions in an acoustic control method according to the background art. FIG. 15B is a schematic diagram showing an actual positional relationship between the hearer and speakers in reproducing an acoustic signal in the acoustic control method according to the background art. The "positional relationship, between a hearer and a speaker, meeting desired hearing conditions" will be hereinafter referred to as a "desired system", whereas the "actual positional relationship between the hearer and speakers in reproducing an acoustic signal" will be hereinafter referred to as a "reproduction system".

In the configuration of desired system 10 shown in FIG. 15A, desired speaker 203 reproduces the acoustic signal, which reaches both the ear positions of hearer 101. The "desired speaker" here is an imaginary speaker located in a position causing hearer 101 to recognize the generation of the acoustic signal regardless of the actual position of the speaker. That is, the speaker is an imaginary speaker located in any place to which the sound of the acoustic signal is localized. FIG. 15B shows a configuration of reproduction system including filter processor 350 that performs sound control processing of the acoustic signal. The signal is reproduced by left speaker 201 and right speaker 202 and reaches both the ear positions of hearer 100.

Assume that the acoustic signal obtained in both the ear positions of hearer 101 in the configuration of desired system 10 is identical with the acoustic signal obtained in both the ear positions of hearer 100 in the configuration of reproduction system 20. In this case, hearer 100 recognizes the sound from the position of desired speaker 203 as viewed from hearer 101 in the configuration of reproduction system 20, although the acoustic signal comes from left speaker 201 and right speaker 202. That is, the acoustic signal obtained in both the ear positions of hearer 101 in the configuration of desired system 10 is controlled to be identical with the acoustic signal obtained in both the ear positions of hearer 100 in the configuration of reproduction system 20. This allows the control causing hearer 101 to recognize the sound from the position of desired speaker 203.

Such a control method has been used as a method of reproducing a realistic feeling to be obtained in the configuration of desired system 10, in the configuration of reproduction system 20 that is physically different from the configuration of desired system 10.

Specifically, the transfer functions from left speaker 201 and right speaker 202 to both ears of hearer 100 in the configuration of reproduction system 20 are measured in advance. The measured transfer functions are subjected to predetermined convolution (calculation) to obtain the transfer functions from desired speaker 203 to both ears of hearer 101 in the configuration of desired system 10. The configuration of reproduction system 20 includes filter processor 350 for convolving input acoustic signal S as shown in FIG. 15B.

Filter processor 350 includes filter Xl and filter Xr as shown in FIG. 15B. Filter Xl and filter Xr have transfer functions Hll, Hlr, Hrl, and Hrr from left speaker 201 and right speaker 202 to both the ear positions of hearer 100. On the other hand, in the configuration of desired system 10, Dl and Dr are the transfer functions from desired speaker 203 to both the ear positions of hearer 101.

Transfer functions Hll, Hlr, Hrl, and Hrr used in filter processor 350 will be hereinafter referred to as the values in the frequency domain. Actually, the suffixes w indicating the frequencies need to be added like Hll (co) but will be omitted for simplification.

The convolution of the transfer functions measured in advance in reproduction system 20 is expressed by multiplication in the frequency domain. Transfer functions Hll, Hlr, Hrl, and Hrr set for filter Xl and filter Xr can be designed in accordance with Expression (1) (see, e.g., NPL 1).

[Math. 1]

$$\begin{bmatrix} Dl \\ Dr \end{bmatrix} S = \begin{bmatrix} Hll & Hrl \\ Hlr & Hrr \end{bmatrix} \begin{bmatrix} Xl \\ Xr \end{bmatrix} S \tag{1}$$

$$\begin{bmatrix} Xl \\ Xr \end{bmatrix} = \begin{bmatrix} Hll & Hrl \\ Hlr & Hrr \end{bmatrix}^{-1} \begin{bmatrix} Dl \\ Dr \end{bmatrix}$$

$$\begin{bmatrix} Xl \\ Xr \end{bmatrix} = \frac{1}{Hll * Hrr - Hlr * Hrl} \begin{bmatrix} Hrr & -Hrl \\ -Hlr & Hll \end{bmatrix} \begin{bmatrix} Dl \\ Dr \end{bmatrix}$$

Note that the functions used in Expression (1) may be in any of the time domain and the frequency domain.

Filter processor 350 designed here in accordance with Expression (1) has transfer functions Hll, Hlr, Hrl, and Hrr from left speaker 201 and right speaker 202 to both ears of hearer 100 measured in advance. Assume that hearer 100 moves from the position in which transfer functions Hll, Hlr, Hrl, and Hrr were measured. In this case, the transfer functions from left speaker 201 and right speaker 202 to both ears of hearer 100 in the position after the movement become different from Hll, Hlr, Hrl, and Hrr. In reproduction system 20, filter processor 350 designed in accordance with Expression (1) cannot generate the signal obtained in both the ear positions of hearer 101 in desired system 10. That is, the effects of the sound localization control cannot be obtained.

For example, PTL 1 teaches the problem of obtaining the effects of the sound localization control in limited hearing positions. PTL 1 discloses a method of achieving more robust control not by reproducing the absolute sound pressures at both the ear positions of hearer 100 but by causing an interaural difference. It is however anticipated in the method disclosed in PTL 1 that expected sound localization control effects are not obtained, if the hearer moves at a long distance. It also applies if the hearer moves at a slight distance but the transfer functions from the reproducing speaker to both the ear positions of the hearer largely change under the influence of the reproduction environment.

To address the problem, the present disclosure provides a signal processing device and a signal processing method that give a hearer sound control effects, even if the hearing position of the hearer changes.

Now, embodiments of the signal processing device and the signal processing method according to the present disclosure will be described in detail with reference to the drawings as appropriate. In the following embodiments, the same reference marks are used to represent substantially the same configurations, and the explanation thereof may be omitted.

Note that the embodiments described below are mere specific examples. The numerical values, shapes, materials, constituent elements, the arrangement and connection of the constituent elements, steps, step orders etc. shown in the following embodiments are thus mere examples, and are not intended to limit the scope of the present disclosure. Among the constituent elements in the following embodiments, those not recited in any of the independent claims defining the broadest concept are described as optional constituent elements. Note that unnecessarily detailed description may be omitted. For example, detailed description of well-known matters or duplicated description of substantially the same configurations may be omitted. This is for reduction in unnecessarily redundant description and easier understanding of those skilled in the art. In the following, the same reference marks are used to represent the same or unchanged configurations.

The appended drawings and the following description are for those skilled in the art to sufficiently understand the present disclosure and are not intended to limited the subject matters of the claims.

Embodiment 1

[1-1. Configuration of Signal Processing System]

Figure 1:
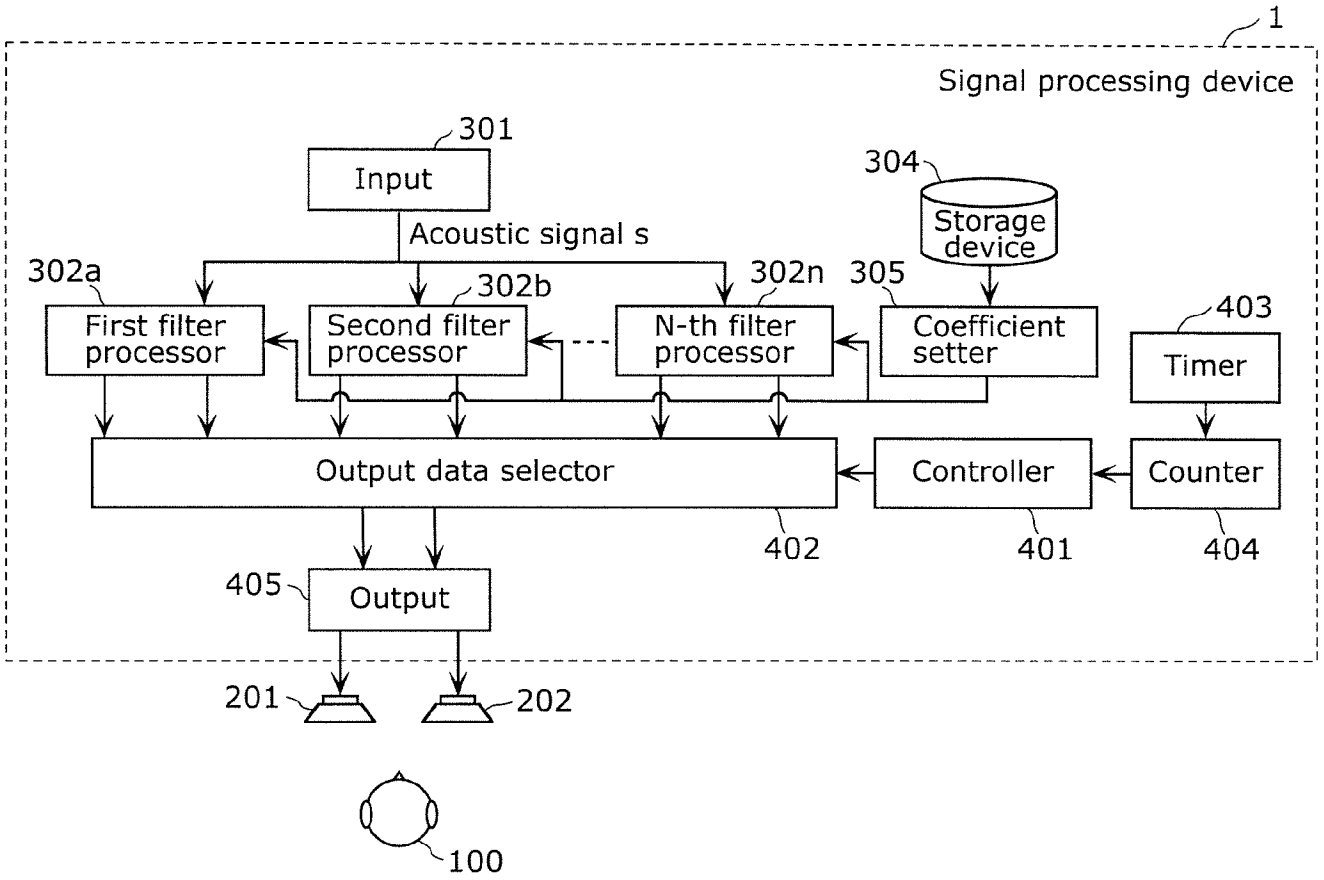
FIG. 1 is a block diagram showing an example configuration of a signal processing device according to Embodiment 1, speakers, and a hearer.

First, a configuration of a signal processing system according to Embodiment 1 will be described. FIG. 1 is a block diagram showing an example configuration of the signal processing system according to Embodiment 1.

As shown in FIG. 1, the signal processing system according to this embodiment includes signal processing device 1, left speaker 201, and right speaker 202.

Signal processing device 1 processes an input acoustic signal and outputs the processed signal to left speaker 201 and right speaker 202. A configuration and an operation of signal processing device 1 will be described later in more detail. Note that the constituent elements of signal processing device 1 may be dedicated hardware devices or may be achieved by executing software programs suitable for the constituent elements. The constituent elements may be achieved by a program executor, such as a CPU or a processor, reading and executing software programs stored in a storage medium such as a hard disk or a semiconductor memory. Alternatively, the constituent elements may be large-scale integrated (LSI) circuits, dedicated circuits, general-purpose processors, field-programmable gate arrays (FPGAs), or reconfigurable processors capable of reconfiguring connections and settings of circuit cells inside an LSI circuit.

Note that signal processing device 1 may include left speaker 201 and right speaker 202.

Left speaker 201 and right speaker 202 output the acoustic signal processed by signal processing device 1. In this embodiment, left speaker 201 is a first speaker, and right speaker 202 is a second speaker. Left speaker 201 and right speaker 202 intend to reproduce input signals over the full bandwidth, for example.

Left speaker 201 and right speaker 202 are located in different positions. For example, as shown in FIG. 1, left speaker 201 and right speaker 202 are symmetrical about hearer 100. Left speaker 201 is located on the left of hearer 100. Right speaker 202 is located on the right of hearer 100.

[1-2. Configuration of Signal Processing Device]

As shown in FIG. 1, signal processing device 1 includes input 301, a plurality of filter processors, storage device 304, coefficient setter 305, controller 401, output data selector 402, timer 403, counter 404, and output 405. In this embodiment, signal processing device 1 includes, as the plurality of filter processors, first filter processor 302*a*, second filter processor 302*b*, . . . , and n-th filter processor 302*n*. Note that first filter processor 302*a*, second filter processor 302*b*, . . . , and n-th filter processor 302*n* may be collectively referred to as "first filter processor 302*a* to *n*-th filter processor 302*n*".

Input 301 receives acoustic signal S from the outside of signal processing device 1. Input 301 outputs the acoustic signal received from the outside of signal processing device 1 to first filter processor 302*a* to *n*-th filter processor 302*n*.

First filter processor 302*a* to *n*-th filter processor 302*n* perform sound control processing for sound localization of acoustic signal S input from input 301. First filter processor 302*a* to *n*-th filter processor 302*n* are, for example, finite impulse response (FIR) filters. Note that first filter processor 302*a* to *n*-th filter processor 302*n* are not limited to the FIR filters and may be for example, infinite impulse response (IIR) filters or a combination of FIR filters and IIR filters. The transfer functions of the filter processors may be designed in the frequency domain or in the time domain employing the least-squares method. First filter processor 302*a* to *n*-th filter processor 302*n* may not have fixed filter coefficients and may be adaptive filters with filter coefficients variable over time in accordance with feedback, for example.

Storage device 304 stores the filter coefficients for first filter processor 302*a* to *n*-th filter processor 302*n* to perform the sound control processing. As will be described later, the filter coefficients are generated under a plurality of hearing conditions. The hearing conditions are, for example, the conditions of a plurality of physically closer hearing positions or the size of the head of the hearer. The filter coefficients of first filter processor 302*a* to *n*-th filter processor 302*n* are stored in a coefficient table, which includes, for example, first filter processor 302*a* to *n*-th filter processor 302*n* in association with the filter coefficients.

Coefficient setter 305 sets the filter coefficients for first filter processor 302*a* to *n*-th filter processor 302*n*. Coefficient setter 305 reads the filter coefficients from storage device 304 and sets the coefficients for the filter processors.

Output data selector 402 selects, out of the output signals (i.e., the output data) subjected to the sound control processing by first filter processor 302*a* to *n*-th filter processor 302*n*, those to be output through left speaker 201 and right speaker 202. As will be described later, output data selector 402 includes a plurality of gain adjusters, adder 421, and adder 422. In this embodiment, adder 421 is a first adder, and adder 422 is a second adder.

Output data selector 402 outputs the selected output data to output 405. Note that a configuration and an operation of output data selector 402 will be described later in more detail.

Controller 401 causes output data selector 402 to select the output data to be output through left speaker 201 and right speaker 202. Controller 401 adjusts the respective gains set for the gain adjusters. Specifically, controller 401 performs control for switching the respective gains set for the gain adjusters and multiplying the gains by the output data. Controller 401 causes output data selector 402 to switch the output data based on predetermined times for switching the output data.

At timer 403, the times for output data selector 402 to switch/select the output data are set in advance. Counter 404 counts elapsed times. In this embodiment, timer 403 and counter 404 are time measurers that monitor the times for output data selector 402 switching the output data. When a time set at timer 403 has elapsed, counter 404 notifies controller 401 of the elapse of time. Note that timer 403 and counter 404 may be included inside controller 401 or may be attached outside controller 401.

[1-3. Operation of Signal Processing Device]

Now, an operation of signal processing device 1 will be described.

Acoustic signal S is input through input 301 and subjected to the sound control processing by first filter processor 302*a* to *n*-th filter processor 302*n*. At this time, coefficient setter 305 reads the filter coefficients of first filter processor 302*a* to *n*-th filter processor 302*n* from the coefficient table stored in storage device 304, and sets the coefficients for first filter processor 302*a* to *n*-th filter processor 302*n*.

The transfer functions of first filter processor 302*a* to *n*-th filter processor 302*n* are designed based on Expression (1) under different conditions. The output signals, that is, the output data subjected to the sound control processing by first filter processor 302*a* to *n*-th filter processor 302*n* are input to output data selector 402.

Under the control by controller 401, output data selector 402 selects the output data subjected to the sound control processing by first filter processor 302*a* to *n*-th filter processor 302*n* to be output through left speaker 201 and right speaker 202. The selector outputs then the selected output data to output 405. The output data output to output 405 are as acoustic signals output through left speaker 201 and right speaker 202.

In the present disclosure, the expression "selects the output data" is also referred to as "switches the output data". As will be described later, the expression "selects the output data" or "switches the output data" specifically means switching the gains of gain adjusters 412*a* to 412*n* located in output data selector 402 and multiplying, at gain adjusters 412*a* to 412*n*, the gains by the acoustic signal subjected to the sound control processing by first filter processor 302*a* to *n*-th filter processor 302*n*.

Figure 2:
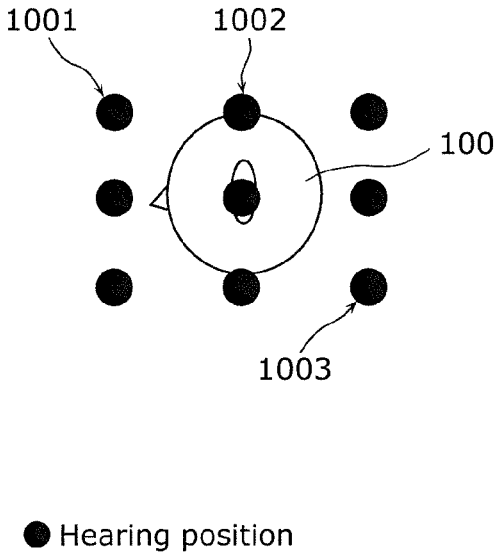
FIG. 2 shows example hearing positions in designing filter processors according to Embodiment 1.

FIG. 2 shows here example hearing positions in designing first filter processor 302*a* to *n*-th filter processor 302*n* according to this embodiment. FIG. 2 shows example design conditions of the filter coefficient, under which the filter coefficients are designed while changing the hearing positions. FIG. 2 shows an example of hearer 100 and the hearing positions as viewed from the left ear of hearer 100. Hearing positions 1001, 1002 and 1003 are supposed positions in which the left ear of hearer 100 is supposed to be located. The filter coefficients are designed in the positions in which hearer 100 is supposed to hear the sound. That is, the hearing conditions for generating the filter coefficients include at least the information on the hearing positions to which the hearer is likely to move. The interval between the hearing positions shown in FIG. 2 is, for example, 5 cm.

As described above, the filter coefficients are stored, in the coefficient table, in storage device 304 of FIG. 1. The filter coefficients designed in this manner are set for first filter processor 302*a* to *n*-th filter processor 302*n* shown in FIG. 1 by coefficient setter 305.

Figure 3:
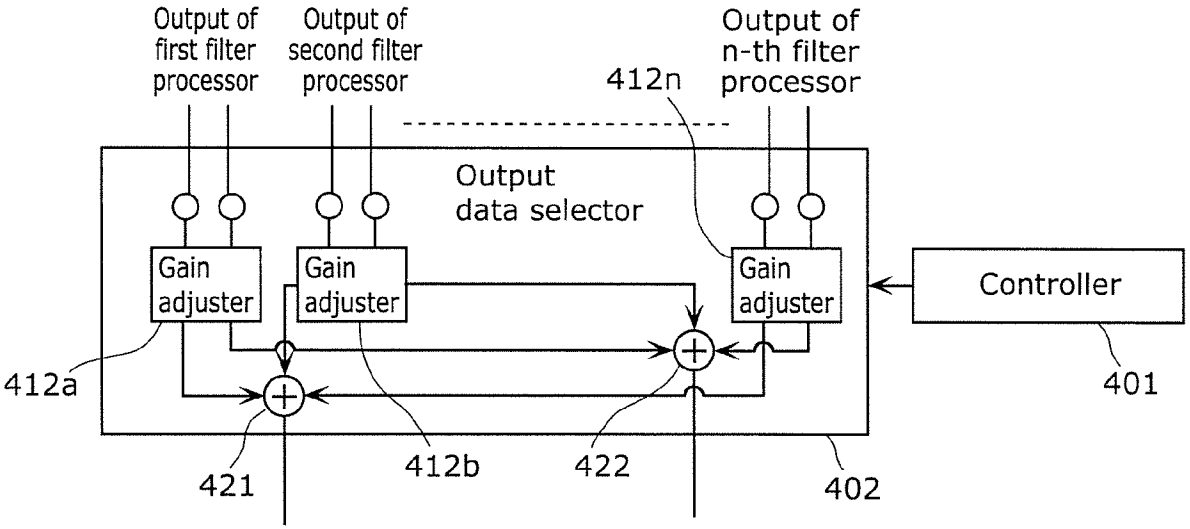
FIG. 3 is a block diagram showing a configuration of an output data selector according to Embodiment 1.

FIG. 3 is a block diagram showing a configuration of output data selector 402 according to this embodiment. Output data selector 402 includes a plurality of gain adjusters, adder 421, and adder 422. The gain adjusters are provided, for example, in the same number as the filter processors in one to one correspondence.

In this embodiment, output data selector 402 includes, as the plurality of gain adjusters, gain adjusters 412*a*, 412*b*, . . . , and 412*n*. Gain adjusters 412*a*, 412*b*, . . . , and 412*n* correspond to first filter processor 302*a*, second filter processor 302*b*, . . . , and n-th filter processor 302*n*, respectively. In the following, gain adjusters 412*a*, 412*b*, . . . , and 412*n* may be collectively referred to as "gain adjusters 412*a* to 412*n*".

In output data selector 402, gain adjusters 412*a* to 412*n* multiply the gains by the acoustic signal subjected to the sound control processing by first filter processor 302*a* to *n*-th filter processor 302*n*. More specifically, the acoustic signal output from left speaker 201 are multiplied by the gain independently from the acoustic signal output from right speaker 202. In addition, the acoustic signal output from left speaker 201 and the acoustic signal output from right speaker 202 are multiplied by the same gain.

At this time, controller 401 receives the information on the timing for switching the gains of gain adjusters 412*a* to 412*n* from timer 403 and counter 404. Controller 401 changes then the values of gains g1, g2, . . . , and gn set for gain adjusters 412*a* to 412*n* of output data selector 402 at the obtained timing. Gain adjusters 412*a* to 412*n* multiply the gains by the output data processed by the filter processors. In this manner, output data selector 402 selects the output data to be output through left speaker 201 and right speaker 202.

Out of the output data multiplied by the gains by gain adjusters 412*a* to 412*n*, the output data to be output through left speaker 201 is added by adder 421. On the other hand, out of the output data multiplied by the gain, the output data to be output through right speaker 202 is added by adder 422. The output data added by adders 421 and 422 is output as the acoustic signals through left speaker 201 and right speaker 202.

Figure 4:
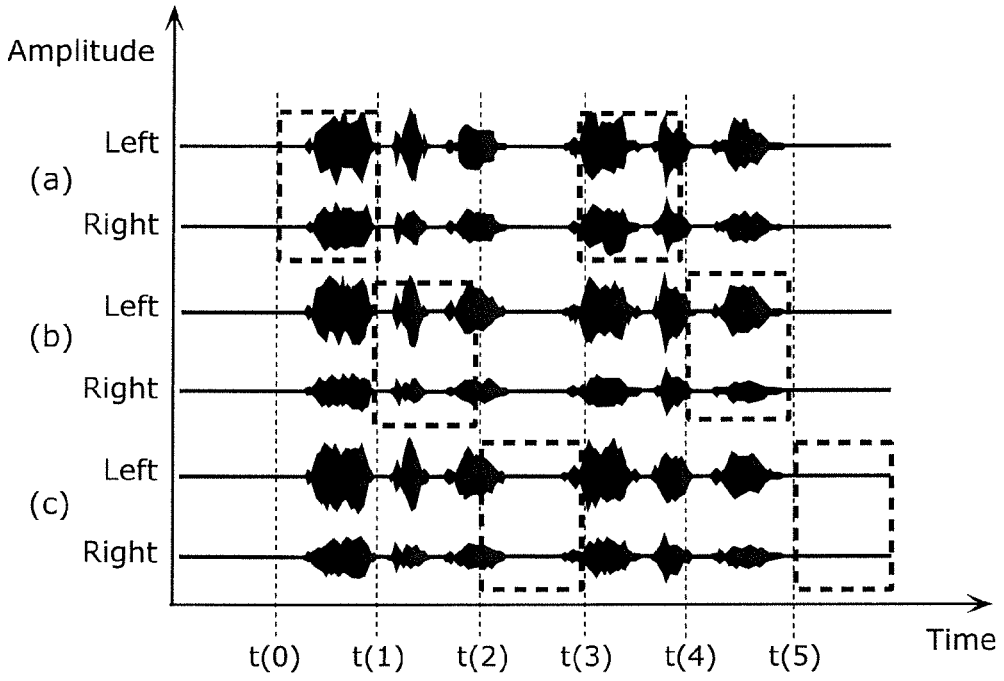
FIG. 4 shows example output signals obtained by the output data selector according to Embodiment 1.

FIG. 4 shows example acoustic signals obtained by output data selector 402 according to this embodiment. In (a) to (c) of FIG. 4, the horizontal axis represents the time, whereas the vertical axis represents the amplitude levels of the output signals. In each of (a) to (c) of FIG. 4, the upper stage represents the output data for left speaker 201, whereas the lower stage represents the output data for right speaker 202.

In the periods surrounded by the broken rectangles in (a) to (c) of FIG. 4, the output data selected by output data selector 402 is output. As shown in FIG. 4, signal processing device 1 according to this embodiment performs control for switching the output data at times t(0), t(1), . . . , and t(5). The transition periods between times t(0), t(1), . . . , and t(5) are constant.

Assume that the gains set for gain adjusters 412*a*, 412*b*, . . . , and 412*n* are g1, g2, . . . , and gn. In this case, gain adjusters 412*a* to 412*n* switch gains g1 to gn of gain adjusters 412*a* to 412*n* to be g1=1, g2=0, . . . , and gn=0 in the transition period from time t(0) to time t(1), and to be g1=0, g2=1, . . . , and gn=0 in the transition period from time t(1) to time t(2). As shown in (a) to (c) of FIG. 4, the output data from first filter processor 302*a* to *n*-th filter processor 302*n* may be switched at certain times, selected sequentially, and output to output 405.

Each time interval (i.e., the time difference) Δt for switching the output data is set to a value ranging, for example, from about 0.1 seconds to about 0.5 seconds, depending on the type and length of input acoustic signal S. If acoustic signal S indicates meaningful wording (e.g., "dangerous" or "there is an obstacle"), each time interval may be a continuous time causing the hearer to hear the wording at least once. If acoustic signal S serves as an intermittent alarm, the time interval may be shortened in accordance with the continuous time of the alarm for one period.

Figure 5:
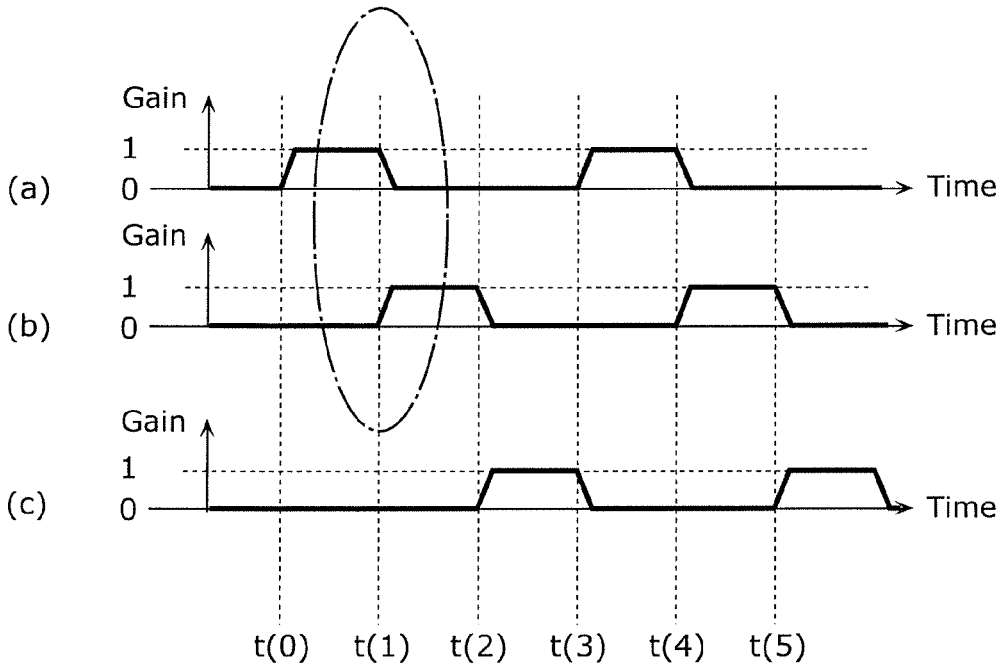
FIG. 5 shows example gain settings by gain adjusters of the output data selector according to Embodiment 1.
Figure 6:
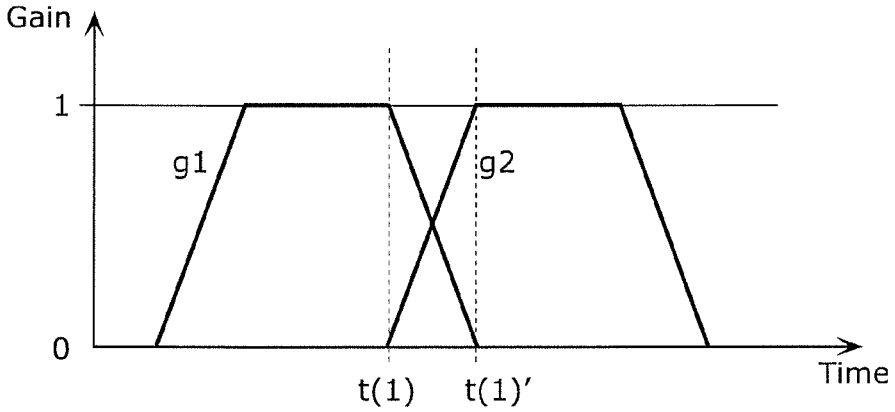
FIG. 6 shows superposition of two of the example gain settings by the gain adjusters shown in FIG. 5.

FIG. 5 shows example gain settings for gain adjusters 412*a* to 412*n* of output data selector 402 according to Embodiment 1. FIG. 6 shows superposition of two of the gains of gain adjusters 412*a* to 412*n* shown in FIG. 5. An example has been described in FIGS. 3 and 4 where the outputs of first filter processor 302*a* to *n*-th filter processor 302*n* are switched at the switch timing. As shown in FIGS. 5 and 6, out of the gains of gain adjusters 412*a* to 412*n*, those set for two filter processors continuously output the signals are cross-faded. This reduces the noises generated at the switch timing.

Changes in the gains in the transition period from time t(1) to time t(1)' that is the gain switching time will be described with reference to FIG. 6. As shown in FIG. 6, the value of gain g1 gradually decreases from time t(1) and reaches zero at time t(1)'. On the other hand, gain g2 is zero until time t(1) but gradually increases from time t(1) and reaches time t(1)'. At this time, gains g1 and g2 change to satisfy the equation g1+g2=1.

In this embodiment, an example has been described where gains g1 and g2 are cross-faded as indicated by the straight lines in the transition period from time t(1) to time t(1)'. Instead, gains g1 and g2 may be cross-faded as indicated by sine- or cosine-squared curves.

The transition period (e.g. from time t(1) to time t(1)') shown in FIG. 6 is generally set to a value smaller than time difference Δt, but is not limited thereto.

[1-4. Signal Processing Procedure of Signal Processing Device]

Figure 7:
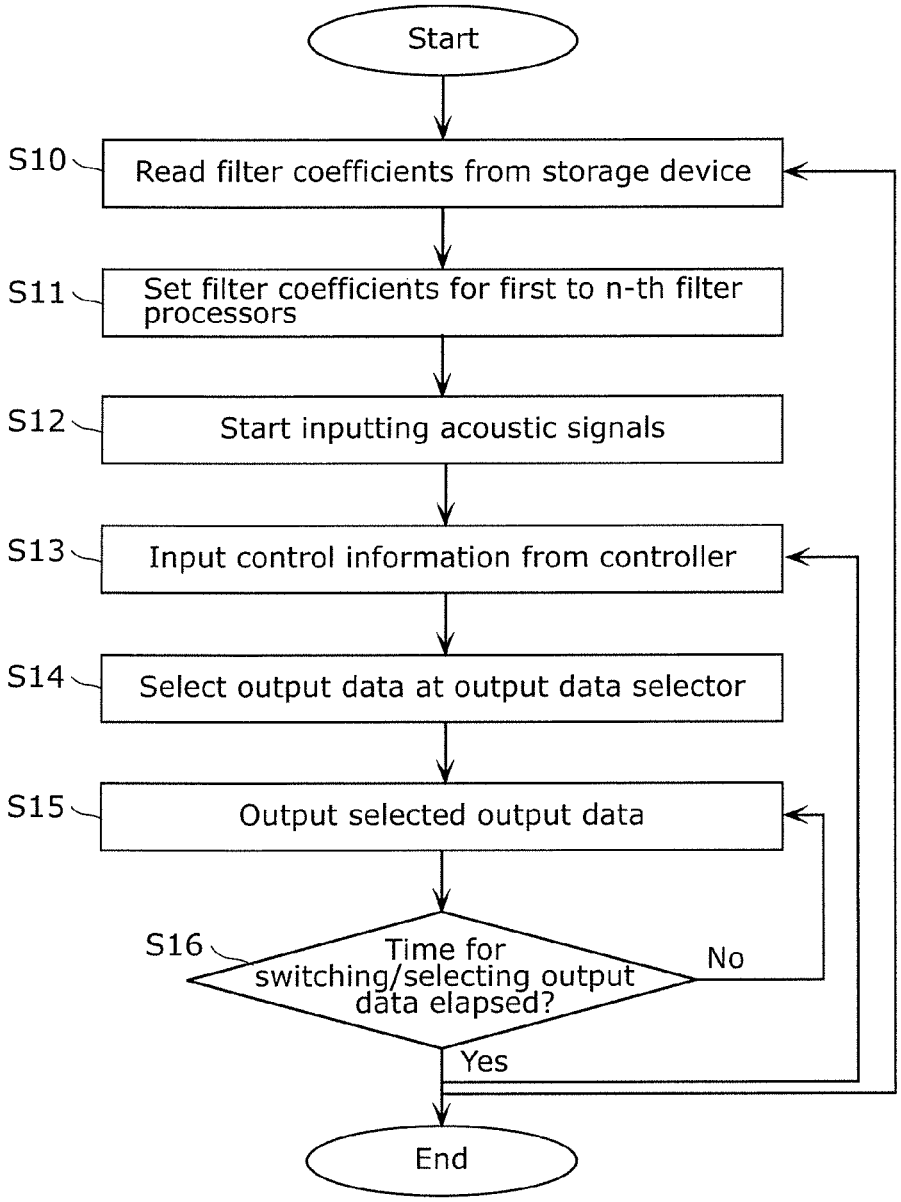
FIG. 7 is a flow chart showing an operation of the signal processing device according to Embodiment 1.

Now, a procedure of the signal processing performed by signal processing device 1 will be described. FIG. 7 is a flow chart showing an operation of signal processing device 1 according to this embodiment.

First, at a time of initial setting such as startup, coefficient setter 305 reads the filter coefficients from storage device 304 (step S10). The read filter coefficients are then set for first filter processor 302*a* to *n*-th filter processor 302*n* (coefficient setting processing) (step S11).

Acoustic signal S starts then to be input to first filter processor 302*a* to *n*-th filter processor 302*n* (step S12). Input acoustic signal S is subjected to the sound control processing by first filter processor 302*a* to *n*-th filter processor 302*n* (filter processing).

After that, controller 401 inputs control information to output data selector 402 and causes the selector to select the output signals (control processing) (step S13). Subsequently, output data selector 402 sequentially selects, as the output data, the acoustic signal subjected to the sound control processing by first filter processor 302*a* to *n*-th filter processor 302*n* (output data selecting processing) (step S14). The selected output data is then output from output data selector 402 to output 405. The output data output to output 405 is output as an acoustic signal through selected left speaker 201 or right speaker 202 (step S15).

Counter 404 counts the time while outputting the output data to detect whether the time for switching/selecting the output data set at timer 403 has elapsed (time measuring processing) (step S16).

If the time for switching/selecting the output data set at timer 403 has elapsed (Yes in step S16), controller 401 causes output data selector 402 to switch the output data and repeats steps S13, S14, and S15. Namely, in step S13, the control information is input to output data selector 402. In step S14, output data selector 402 selects the output data. In step S15, the acoustic signal after the filter processing is output. If the time for switching/selecting the output data set at timer 403 has elapsed, signal processing device 1 may end the processing or may repeat the processing in step S10 to step S15 again without ending the processing.

If the time for switching/selecting the output data set at timer 403 has not elapsed (No in step S16), the selected output data continues to be output (step S15).

Accordingly, the sound is sequentially localized to the hearing positions shown in FIG. 2. That is, the sound sequentially moves among the hearing positions. As a result, hearer 100 recognizes the acoustic signal at any time in any one of the hearing positions.

[1-5. Effects, Etc.]

Signal processing device 1 with the configuration described above processes acoustic signal S in the operation shown in the flow chart in FIG. 7. This causes hearer 100 to hear the sounds output any time from left speaker 201 and right speaker 202 and suitable for the hearing position. Accordingly, signal processing device 1 gives hearer 100 desired sound control effects.

Embodiment 2

[2-1. Configuration and Operation of Signal Processing Device]

Now, a signal processing system and signal processing device 2 according to Embodiment 2 will be described. Different from signal processing device 1 according to Embodiment 1, signal processing device 2 according to this embodiment sets the range of the filter coefficients for use.

Figure 8:
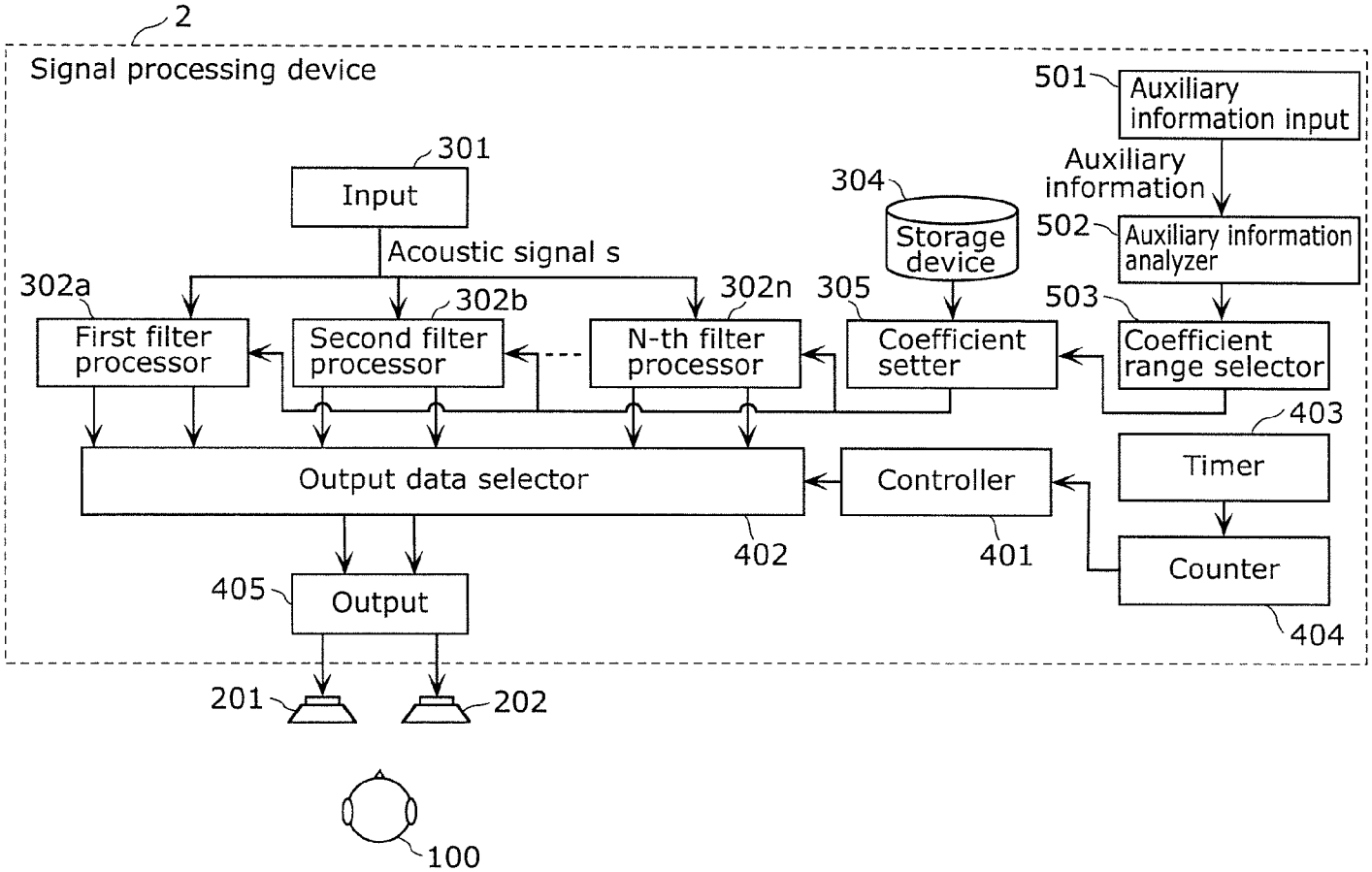
FIG. 8 is a block diagram showing an example configuration of a signal processing device according to Embodiment 2, speakers, and a hearer.

FIG. 8 is a block diagram showing an example configuration of the signal processing system according to this embodiment. As shown in FIG. 8, the signal processing system according to this embodiment includes signal processing device 2, left speaker 201, and right speaker 202. Note that left speaker 201 and right speaker 202 have the configurations the same or similar to left speaker 201 and right speaker 202 shown in Embodiment 1 and the explanation thereof will thus be omitted.

As shown in FIG. 8, signal processing device 2 includes auxiliary information input 501, auxiliary information analyzer 502, and coefficient range selector 503 in addition to the configuration of signal processing device 1 shown in FIG. 1.

Auxiliary information input 501 receives auxiliary information for selecting the range of the filter coefficients set for first filter processor 302*a* to *n*-th filter processor 302*n*. The auxiliary information relates to the hearing position of hearer 100 for selecting the range of the filter coefficients set for first filter processor 302*a* to *n*-th filter processor 302*n* by coefficient setter 305. The auxiliary information may include, for example, the information on both the ear positions of hearer 100 or the information on the seated position of hearer 100. The auxiliary information may include the information on the position of the seat on which hearer 100 is seated.

For example, if signal processing device 2 according to this embodiment is applied to in-vehicle equipment, the auxiliary information may be controller area network (CAN) information including the information on the position of the seat for hearer 100 or image information obtained by a vehicle interior camera placed in a drive recorder, for example.

Auxiliary information analyzer 502 analyzes the input auxiliary information and extracts, out of the auxiliary information, the information useful for detecting the hearing position of hearer 100. For example, the input auxiliary information is the CAN information, auxiliary information analyzer 502 analyzes the input CAN information and obtains the information on the position of the seat from the input CAN information. On the other hand, assume that the input auxiliary information is the image information from the drive recorder. In this case, auxiliary information analyzer 502 analyzes the image information using a technique such as an image recognition technique to recognize the position of the face of the driver and extracts the information on the hearing position of the driver.

Based on the result of analysis by auxiliary information analyzer 502, coefficient range selector 503 selects one of the filter coefficients stored in storage device 304 for use and the range (i.e., the coefficient range) of the filter coefficient for use. Coefficient range selector 503 inputs the filter coefficient within the selected coefficient range to coefficient setter 305.

Figure 9:
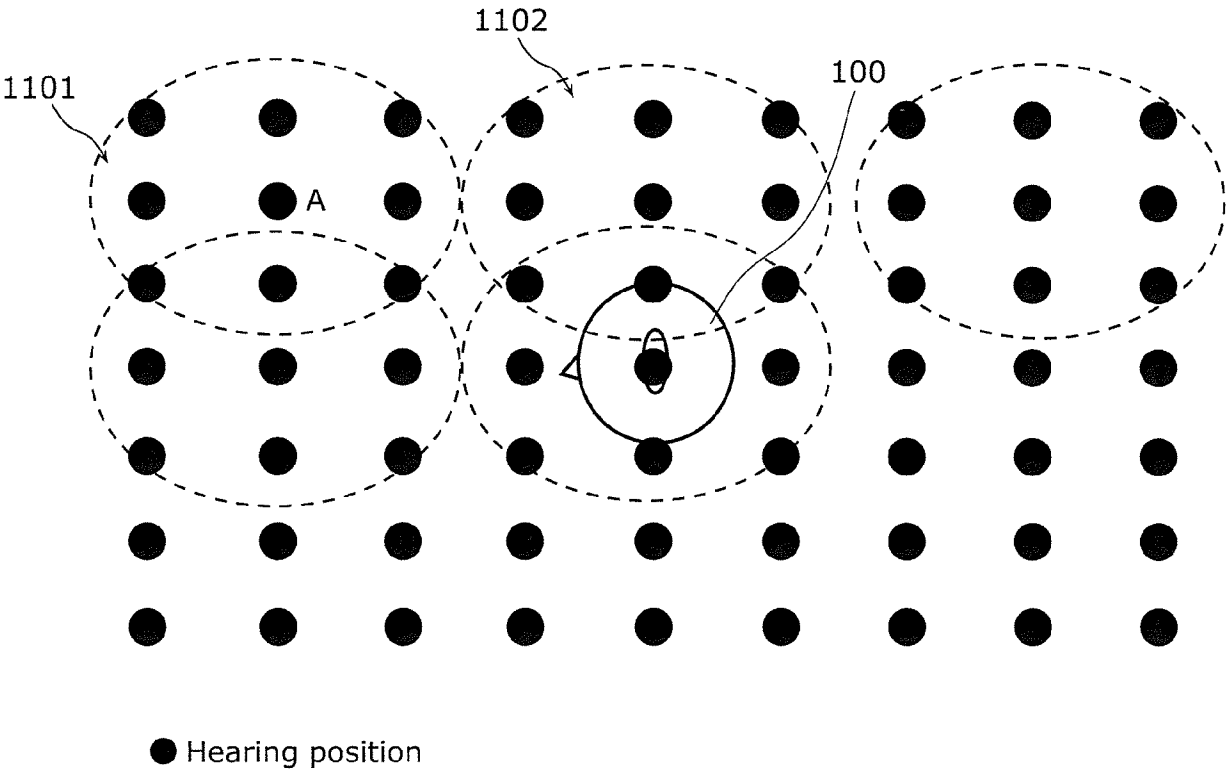
FIG. 9 shows an example of hearing positions and a group of hearing positions in designing filter processors according to Embodiment 2.

FIG. 9 shows an example of hearing positions and a group of hearing positions in designing first filter processor 302*a* to *n*-th filter processor 302*n* according to this embodiment. More specifically, FIG. 9 shows example settings of the range of the filter coefficients for use set by coefficient range selector 503. Like the hearing positions shown in FIG. 2, FIG. 9 shows an example of hearer 100 and expected hearing positions in designing first filter processor 302*a* to *n*-th filter processor 302*n* as viewed from the left ear of hearer 100.

In signal processing device 2, storage device 304 stores a plurality of filter coefficients designed under a plurality of hearing conditions shown as the hearing positions in FIG. 9. The filter coefficients stored in storage device 304 are classified into groups depending on the respective hearing positions. For example, assume that the hearer is located in position A as a result of analysis on the auxiliary information obtained by auxiliary information analyzer 502. In this case, coefficient range selector 503 inputs, to coefficient setter 305, as the coefficient range, the information indicating the use of the filter coefficients of the hearing positions included in first group 1101 to which A belongs.

Note that each group, such as first group 1101 or second group 1102, for setting the coefficient range may include the filter coefficients designed in physically closer hearing positions or the filter coefficients designed by changing the size of the head. Alternatively, the group for setting the coefficient range may be designed by combining the plurality of hearing conditions. For example, the hearing position may be classified as a first group, while the size of the head may be classified as the a-th group.

Upon receipt of the output result of coefficient range selector 503, coefficient setter 305 reads the coefficients of the corresponding group from storage device 304 and sets the coefficients for first filter processor 302*a* to *n*-th filter processor 302*n*. For example, in the example group shown in FIG. 9, the coefficients set under nine conditions (i.e., hearing positions) included in first group 1101 are set for first filter processor 302*a* to *n*-th filter processor 302*n*.

Each of first filter processor 302*a* to *n*-th filter processor 302*n* performs the sound control processing of input acoustic signal S and input the processed signal to output data selector 402. Operations (i.e., gain settings) of gain adjusters 412*a* to 412*n* of output data selector 402 are as shown in FIGS. 5 and 6.

[2-2. Signal Processing Procedure of Signal Processing Device]

Figure 10:
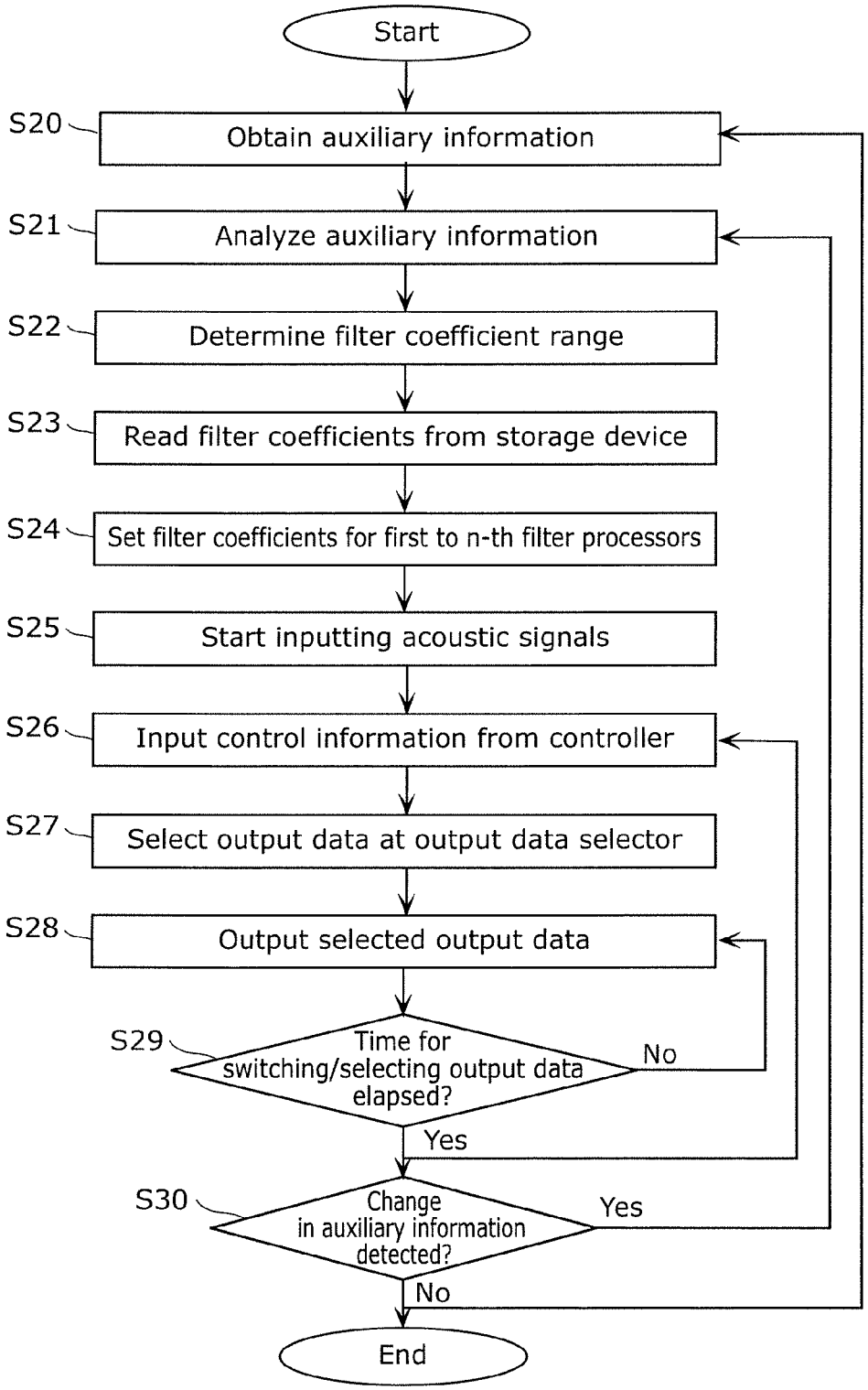
FIG. 10 is a flow chart showing an operation of the signal processing device according to Embodiment 2.

Now, a procedure of the signal processing by signal processing device 2 will be described. FIG. 10 is a flow chart showing an operation of signal processing device 2 according to this embodiment.

First, as described above, in signal processing device 2, auxiliary information input 501 obtains the auxiliary information (obtainment of auxiliary information) (step S20). After that, auxiliary information analyzer 502 analyzes the input auxiliary information and extracts, out of the auxiliary information, the information useful for detecting the hearing position of hearer 100 (step S21). Subsequently, coefficient range selector 503 selects one of the filter coefficients stored in storage device 304 for use and the coefficient range for use (selection of a coefficient range) (step S22).

Based on the coefficient range selected by coefficient range selector 503, coefficient setter 305 reads the filter coefficients from storage device 304 (step S23). Subsequently, coefficient setter 305 sets the filter coefficients for first filter processor 302*a*, second filter processor 302*b*, . . . , and n-th filter processor 302*n* (step S24).

After that, acoustic signal S starts to be input to input 301 (step S25). Input acoustic signal S is subjected to the sound control processing by first filter processor 302*a* to *n*-th filter processor 302*n*. Controller 401 inputs then the control information to output data selector 402 (step S26).

Based on the control information input from controller 401, output data selector 402 sequentially selects, as the output data, the acoustic signal subjected to the sound control processing by first filter processor 302*a* to *n*-th filter processor 302*n* (step S27). The selected output data is then output from output data selector 402 to output 405. The output data output to output 405 is output as an acoustic signal through left speaker 201 or right speaker 202 based on the selected output data (step S28).

As in signal processing device 1 shown in FIG. 7, counter 404 counts the time to detect whether the predetermined time for switching/selecting the output data set at timer 403 has elapsed (step S29).

If the time for switching/selecting the output data set at timer 403 has elapsed (Yes in step S29), controller 401 causes output data selector 402 to switch the output data and repeats step S26, step S27, and step S28. Namely, in step S26, the control information is input to output data selector 402. In S27, output data selector 402 selects the output data. In step S28, the acoustic signal after the filter processing is output. If the time for switching/selecting the output data set at timer 403 has not elapsed (No in step S29), the selected output data continues to be output (step S28).

Once auxiliary information analyzer 502 detects a change in the auxiliary information (Yes in step S30), auxiliary information analyzer 502 analyzes the auxiliary information again (step S21) and repeats the operation in step S22 to step S30. If auxiliary information analyzer 502 detects no change in the auxiliary information (No in step S30), signal processing device 2 ends the processing. If auxiliary information analyzer 502 detects no change in the auxiliary information, signal processing device 2 may end the processing or repeat the processing in step S20 to step S30 again without ending the processing.

Accordingly, the sound is sequentially localized to the hearing positions within in first group 1101 shown in FIG. 9. That is, the sound sequentially moves among the hearing positions within first group 1101. As a result, hearer 100 recognizes the acoustic signal at any time in any one of the hearing positions.

[2-3. Effects, Etc.]

Signal processing device 2 with the configuration described above processes acoustic signal S in the operation shown in the flow chart in FIG. 10. Accordingly signal processing device 2 selects and uses one of the filter coefficients within the group extracted from the filter coefficients stored in storage device 304 based on the auxiliary information input to auxiliary information input 501. This causes signal processing device 2 to hinder the use of the filter coefficients that hardly provide the sound localization control effects. Accordingly, signal processing device 2 gives hearer 100 desired sound control effects.

Embodiment 3

[3-1. Configuration and Operation of Signal Processing Device]

Now, a signal processing system and signal processing device 3 according to Embodiment 3 will be described. Different from signal processing device 1 according to Embodiment 1, signal processing device 3 according to this embodiment changes the switch timing of the acoustic signal output from left speaker 201 and right speaker 202 in accordance with the power of input acoustic signal S.

Figure 11:
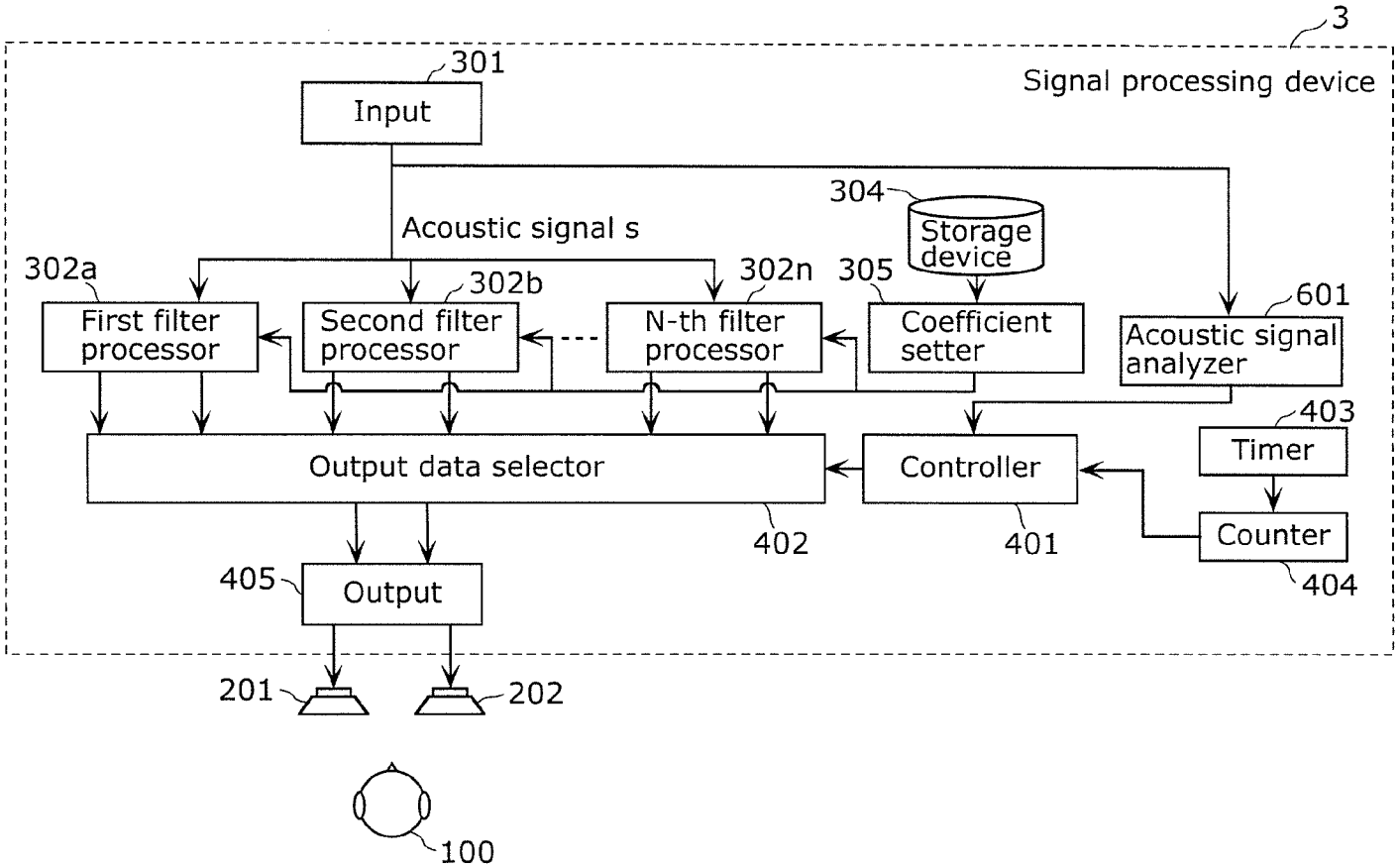
FIG. 11 is a block diagram showing an example configuration of a signal processing device according to Embodiment 3, speakers, and a hearer.

FIG. 11 is a block diagram showing an example configuration of the signal processing system according to this embodiment. As shown in FIG. 11, the signal processing system according to this embodiment includes signal processing device 3, left speaker 201, and right speaker 202. Note that left speaker 201 and right speaker 202 have the configurations the same or similar to left speaker 201 and right speaker 202 shown in Embodiment 1 and the explanation thereof will thus be omitted.

As shown in FIG. 11, signal processing device 3 includes acoustic signal analyzer 601 in addition to the configuration of signal processing device 1 shown in FIG. 1.

Acoustic signal analyzer 601 analyzes the power of input acoustic signal S. Acoustic signal analyzer 601 inputs the result of analysis to controller 401. Based on the power of acoustic signal S analyzed by acoustic signal analyzer 601, controller 401 sets the timing for switching the output data selected by output data selector 402.

The power of acoustic signal S is, for example, the amplitude of acoustic signal S expressed by a decibel. Specifically, the power is a parameter that may be expressed as $20 \log_{10}|Z|$ [dB], where acoustic signal S has amplitude Z. Note that the power of acoustic signal S may be calculated using the square value of the amplitude. In this case, the power may have a momentary square value for each sampling or may be a sum of squares for a certain period.

Figure 12:
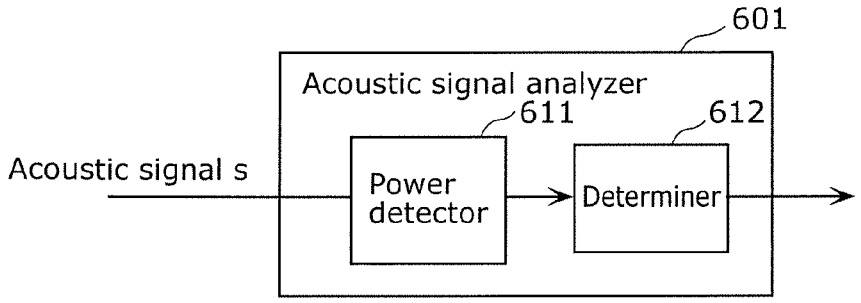
FIG. 12 is a block diagram showing a configuration of an acoustic signal analyzer according to Embodiment 3.

FIG. 12 is a block diagram showing a configuration of acoustic signal analyzer 601 according to this embodiment. As shown in FIG. 12, acoustic signal analyzer 601 includes power detector 611 and determiner 612.

Power detector 611 detects the power of acoustic signal S. Determiner 612 determines whether the power of acoustic signal S is higher than or equal to a threshold.

The power of acoustic signal S input from input 301 to acoustic signal analyzer 601 is detected by power detector 611 of acoustic signal analyzer 601. Based on the detection result, determiner 612 determines whether the power detected by power detector 611 is over a certain threshold, and outputs the determination result to controller 401.

The certain threshold is here, for example, the minimum power value for acoustic signal S to be recognized as an auditory effective acoustic signal. For example, the environmental sound such as the sound of a fan is not regarded as the auditory effective acoustic signal but is background noise. The threshold of the power of the acoustic signal may be at a level that allows detection of the input of auditory effective signals, for example, at a level obtained by adding 6 dB to the level of the acoustic signal of the background noise.

If the power of acoustic signal S at acoustic signal analyzer 601 is over the threshold, controller 401 that receives the result of determining the power of acoustic signal S from determiner 612 causes output data selector 402 to perform the output data selecting operation. This output data selecting operation is performed when the power of acoustic signal S is over the threshold and is not necessarily performed at a certain time interval unlike the selecting operation by signal processing device 1 shown in Embodiment 1. That is, the gains of gain adjusters 412*a* to 412*n* are switched not at a certain time interval but in accordance with the magnitude of the power of input acoustic signal S.

Figure 13:
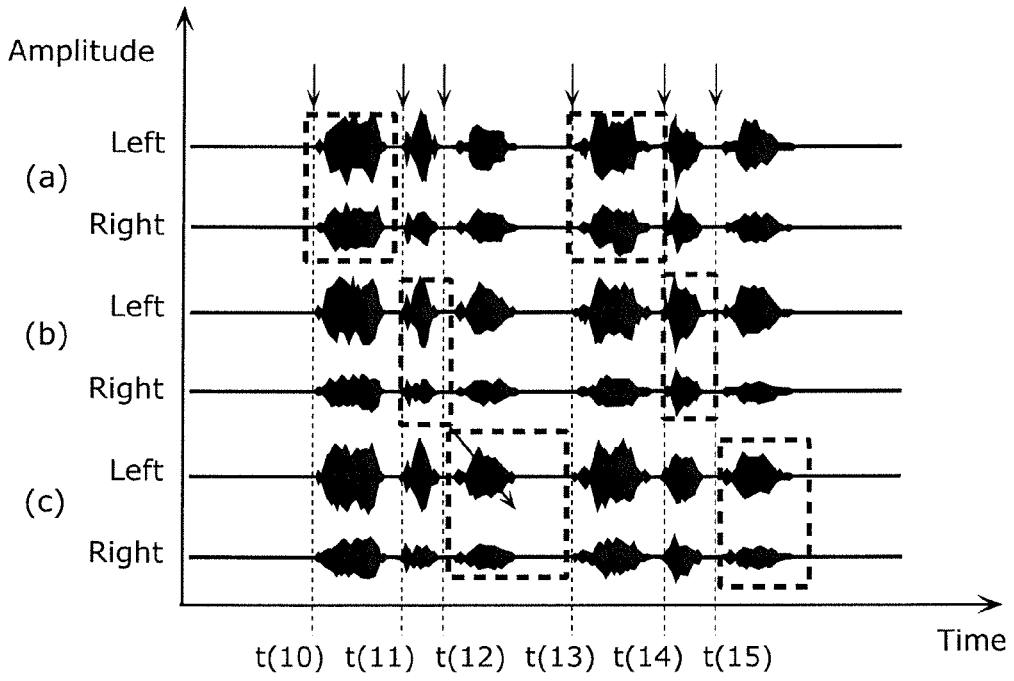
FIG. 13 shows example timing for switching reproduced sounds using an acoustic signal analyzer according to Embodiment 3.

FIG. 13 shows example acoustic signals obtained by output data selector 402 in using acoustic signal analyzer 601 according to this embodiment. In (a) to (c) of FIG. 13, the horizontal axis represents the time, whereas the vertical axis represents the amplitude levels of the output signals. In each of (a) to (c) of FIG. 13, the upper stage represents the output data for left speaker 201, whereas the lower stage represents the output data for right speaker 202.

FIG. 13, (a) to (c) show example timing for switching the reproduced sounds. In the periods surrounded by the broken rectangles in (a) to (c) of FIG. 13, the output data selected by output data selector 402 is output. The vertical arrows shown in FIG. 13 represent the times for controller 401 to perform the switching operation of the reproduced sound.

As shown in (a) to (c) of FIG. 13, signal processing device 3 according to this embodiment performs control for switching the output data at times t(10), t(11), . . . , and t(15). The transition periods between times t(10), t(11), . . . , and t(15) are not constant but controlled by controller 401. Controller 401 controls the timing for switching the output data based on the control information generated by acoustic signal analyzer 601.

Specifically, acoustic signal analyzer 601 determines whether the power of input acoustic signal S changes from a value smaller than a threshold to reach and exceed the threshold. Based on the determination result, controller 401 generates the control information for controlling the timing at which output data selector 402 selects the output data. For example, assume that the power of input acoustic signal S changes from a value smaller than the threshold to a value greater than or equal to the threshold. In this case, acoustic signal analyzer 601 switches the gains of gain adjusters 412*a* to 412*n* of output data selector 402. On the other hand, if the power of input acoustic signal S does not exceed the threshold, acoustic signal analyzer 601 generates the control information not to switch the gains of gain adjusters 412*a* to 412*n* of output data selector 402.

Controller 401 causes output data selector 402 using the control information. Accordingly, the outputs of first filter processor 302*a* to the n-th filter processor are not switched in the period when the power of acoustic signal S does not exceed the threshold. On the other hand, the outputs of first filter processor 302*a* to the n-th filter processor are switched in the period when the power of acoustic signal S has an auditory effective magnitude.

Note that the power of input acoustic signal S may change from a value smaller than the threshold to be a value greater than or equal to the threshold immediately after the start of the input and remain over the threshold. Counter 404 counts the time elapsed after switching the output data. In the case that the time period when the power of acoustic signal S is greater than or equal to the threshold continues for the time set in advance at timer 403, controller 401 may perform the control for switching the output of first filter processor 302*a* to *n*-th filter processor 302*n*.

There is a case where the power of acoustic signal S does not exceed the threshold. In view of the case, acoustic signal analyzer 601 may use the following as conditions for determining acoustic signal S for setting the switch timing. The determination conditions are that the power of acoustic signal S is greater than or equal to the threshold and that the time when the filter processor is selected is over Δt2. Note that Δt2 may be set to a time causing the hearer to recognize that acoustic signal S is an alarm, for example, ranging from 0.1 seconds to 0.5 seconds. Note that Δt2 is not limited thereto and may change in accordance with the type of the acoustic signal.

[3-2. Signal Processing Procedure of Signal Processing Device]

Figure 14:
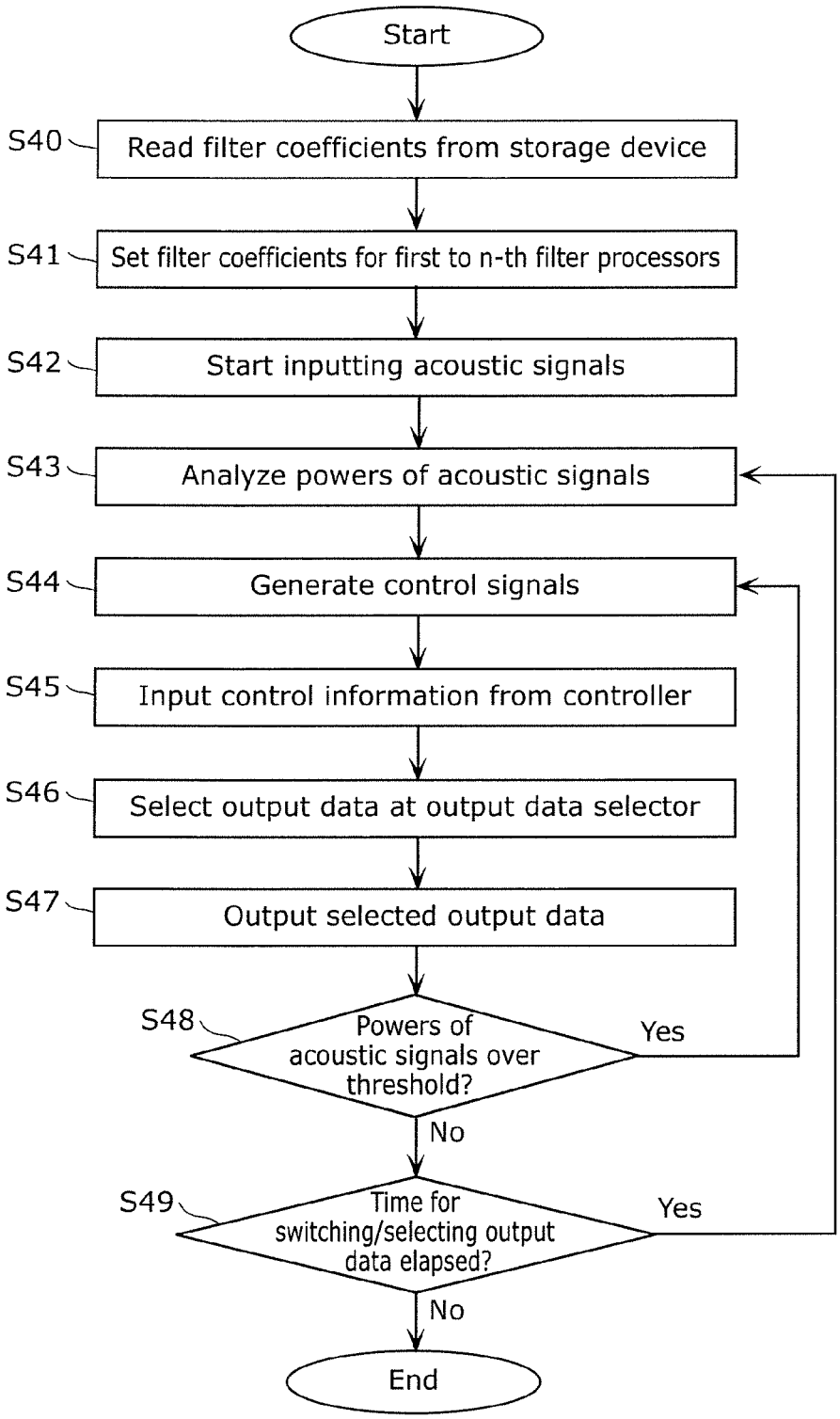
FIG. 14 is a flow chart showing an operation of the signal processing device according to Embodiment 3.

Now, a procedure of the signal processing performed by signal processing device 3 will be described. FIG. 14 is a flow chart showing an operation of signal processing device 3 according to this embodiment.

At a time of initial setting such as start-up, coefficient setter 305 reads the filter coefficients from storage device 304 (step S40). The read filter coefficients are then set for first filter processor 302*a* to *n*-th filter processor 302*n* (step S41).

After that, acoustic signal S starts to be input to first filter processor 302*a* to *n*-th filter processor 302*n* (step S42). Input acoustic signal S is subjected to the sound control processing by first filter processor 302*a* to *n*-th filter processor 302*n*.

Acoustic signal S is then analyzed by acoustic signal analyzer 601 whether the power of acoustic signal S is greater than the threshold set in advance (power detection) (step S43). Based on the result of analysis by acoustic signal analyzer 601, controller 401 generates the control information for causing output data selector 402 to switch the output data (step S44). The control information generated by controller 401 is input from controller 401 to output data selector 402 (step S45).

Subsequently, output data selector 402 sequentially selects, as the output data, the acoustic signal subjected to the sound control processing by first filter processor 302*a* to *n*-th filter processor 302*n* (step S46). The selected output data is then output from output data selector 402 to output 405. The output data output to output 405 is output as an acoustic signal through left speaker 201 or right speaker 202 based on the selected output data (step S47).

Power detector 611 detects the power of acoustic signal S. Based on the detection result, determiner 612 detects whether the power of acoustic signal S changes from a value smaller than the threshold to a value greater than or equal to the threshold (step S48). If the power of acoustic signal S changes from a value smaller than the threshold to a value greater than or equal to the threshold (Yes in step S48), controller 401 generates the control information to switch the output data (step S44). If the power of acoustic signal S does not change from a value smaller than the threshold to a value greater than or equal to the threshold (No in step S48), counter 404 counts the time for outputting the output data. It is then detected whether the time for switching/selecting the output data set at timer 403 has elapsed (step S49).

If the time for switching/selecting the output data set at timer 403 has elapsed (Yes in step S49), controller 401 causes output data selector 402 to switch the output data and performs step S43, step S44, step S45, step S46, and step S47 are performed. Namely, in step S43, the power of acoustic signal S is analyzed. In step S44, controller 401 generates the control signal. In step S45, from controller 401, the control information is input. In step S46, output data selector 402 selects the output data. In step S47, the acoustic signal after the filter processing is output. If the time for switching/selecting the output data set at timer 403 has not elapsed (No in step S49), the selected output data continues to be output (step S47). If the time for switching/selecting the output data set at timer 403 has not elapsed, signal processing device 3 may end the processing or repeat the processing in step S40 to step S49 again without ending the processing.

With this procedure, signal processing device 3 performs control for switching the output data, if the power of input acoustic signal S changes from a value smaller than the threshold to a value greater than or equal to the threshold. The device performs control for maintaining the output data without switching the data, if the power of acoustic signal S does not change from a value smaller than the threshold to a value greater than or equal to the threshold. If the power of acoustic signal S does not change from a value smaller than the threshold to be a value greater than or equal to the threshold for a long time, the device performs control for switching the output data when the time for switching/selecting the output data has elapsed. As a result, hearer 100 recognizes the acoustic signal at any time in any one of the hearing positions.

[3-3. Effects, Etc.]

Signal processing device 3 with the configuration described above processes acoustic signal S in the operation shown in the flow chart in FIG. 14. In signal processing device 3, acoustic signal analyzer 601 analyzes input acoustic signal S to control the timing for switching the output data. Accordingly, signal processing device 3 switches the output data, gives hearer 100 sound control effects and causes the hearer to recognize the acoustic signal in the period when the auditory effective acoustic signal is generated or, if no auditory effective acoustic signal is generated, when the time for switching/selecting the output data has elapsed.

OTHER EMBODIMENTS

The signal processing device according to the aspects of the present disclosure has been described above based on the embodiments. The present disclosure is however not limited to the embodiments. For example, the constituent elements according to the present disclosure may be freely combined or some of the constituent elements may be excluded to form another embodiment of the present disclosure. The present disclosure includes variations obtained by variously modifying the embodiments as conceived by those skilled in the art without departing from the scope and spirit of the present disclosure, that is, the meaning of the wording in the claims.

For example, in the embodiments described above, the filter processors may be FIR filters, IIR filters, or a combination of FIR filters and IIR filters. Having been described where the filter processors are designed in the frequency domain, the method is not limited thereto. The method of obtaining least squares in the time domain may be employed. In addition, the filters may not be fixed filters but adaptive filters.

While an example has been described above in the embodiments where the signal processing device includes three or more filter processors, the configuration is not limited thereto. For example, the device may include only one filter processor whose filter coefficient may be varied by the coefficient setter as appropriate for use. If the device includes IIR filters, the variation in the filter coefficient may cause oscillations. At least two or more filter processors are desired to be used in turn.

While an example has been described above in the embodiments where the output data selector includes three or more gain adjusters, the configuration is not limited thereto. For example, the device may include only one gain adjuster whose gain may be varied by the controller as appropriate.

In Embodiment 1, FIG. 5 shows the example operation of the output data selector switching the outputs of the filter processors and outputting the selected output. FIGS. 5 and 6 show the example of cross-fading and smoothly switching the gains. These configurations are clearly also applicable to Embodiments 2 and 3.

While an example has been described above in the embodiments where left speaker 201 and right speaker 202 intend to reproduce an input signal over the full bandwidth, the configurations are not limited to thereto. Left speaker 201 and right speaker 202 may be multi-way speakers including units such as a tweeter, a squawker, and a woofer associated with the frequencies of signals to be reproduced. In this case, the speakers may include the units in individual cases spaced apart from each other. In addition, the speakers may include a subwoofer capable of reproducing low-frequency effect (LFE) signals.

Left speaker 201 and right speaker 202 may be included in each of the signal processing devices.

The filter processors may include, at the input stage or the output stage, configurations that perform effect processing such as delays, reverbs, or echoes in addition to the processing described above in the embodiments. Examples may be an equalizer or a filter that adjusts frequency characteristics and a gain or an auto gain controller (AGC) that adjusts output amplitudes. At this time, the even characteristics are desired to be multiplied by the outputs of the right and left speakers.

The signal processing device according to the present disclosure has been described above based on the embodiments. The present disclosure is however not limited to the embodiments. The present disclosure includes other embodiments, such as those obtained by variously modifying the embodiments as conceived by those skilled in the art or those achieved by freely combining the constituent elements in the different embodiments without departing from the scope and spirit of the present disclosure.

In the present disclosure, the constituent elements of the signal processing device may be dedicated hardware devices or may be achieved by executing software programs suitable for the constituent elements. The constituent elements may be achieved by a program executor, such as a CPU or a processor, reading and executing software programs stored in a storage medium such as a hard disk or a semiconductor memory. Alternatively, the constituent elements may be LSI circuits, dedicated circuits, general-purpose processors, FPGAs, or reconfigurable processors capable of reconfiguring connections and setting of circuit cells inside an LSI circuit.

In the present disclosure, a D/A converter that converts digital signals into analog signals, an amplifier that amplifies the signals when outputting the signals through the speakers, and other elements have been omitted for simplification. Needless to mention, even if these elements may be software or hardware and output signals through the speakers, the effects of the present disclosure will not change.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The signal processing device according to the present disclosure is applicable as a signal processing device that processes signals at acoustic equipment for generating alarms, or in-vehicle or in-room acoustic equipment, for example.

The invention claimed is:

1. A signal processing device for controlling sound localization, the signal processing device comprising:

one or more filter processors that perform sound localization processing of an input acoustic signal and generate output signals;

a coefficient setter that sets, for the one or more filter processors, a plurality of filter coefficients for use in the one or more filter processors;

an output data selector that selects, out of the output signals subjected to the sound localization processing by the one or more filter processors, an output signal to be output to a speaker;

a time measurer that monitors a time for switching the output signals; and a controller that causes the output data selector to select the output signal in accordance with the time for switching the output signals, wherein the plurality of filter coefficients include filter coefficients generated under a plurality of hearing conditions, the plurality of hearing conditions corresponding to a plurality of different hearing positions, respectively.

2. The signal processing device according to claim 1, wherein the plurality of hearing conditions include at least information on a hearing position to which a hearer is likely to move.

3. The signal processing device according to claim 1, wherein the output data selector includes one or more gain adjusters that adjust gains of the output signals subjected to the sound localization processing to select the output signal to be output to the speaker.

4. The signal processing device according to claim 3, wherein the speaker includes a first speaker and a second speaker in positions different from each other, and the output data selector includes:

a first adder that adds, out of the output signals whose gains are adjusted, an output signal to be output through the first speaker; and a second adder that adds, out of the output signals whose gains are adjusted, an output signal to be output through the second speaker.

5. The signal processing device according to claim 1, further comprising:

an auxiliary information input that inputs auxiliary information on two ear positions or a seated position of the hearer for selecting a range of the plurality of filter coefficients set by the coefficient setter;

an auxiliary information analyzer that analyzes the auxiliary information input; and a coefficient range selector that selects the range of the plurality of filter coefficients set by the coefficient setter based on a result of analysis by the auxiliary information analyzer.

6. The signal processing device according to claim 5, wherein the auxiliary information input inputs, as one of the plurality of filter coefficients, a position of a seat on which the hearer is seated.

7. The signal processing device according to claim 5, wherein the auxiliary information input inputs, as the plurality of filter coefficients, image information including the auxiliary information on the two ear positions.

8. The signal processing device according to claim 1, further comprising:

an acoustic signal analyzer that analyzes the input acoustic signal and inputs the time for switching to the output data selector.

9. The signal processing device according to claim 8, wherein the acoustic signal analyzer includes:

a power detector that detects a power of the input acoustic signal; and a determiner that determines whether the power of the input acoustic signal is greater than or equal to a threshold.

10. A signal processing method of controlling sound localization, the signal processing method comprising:

filtering, by one or more filter processors, an input acoustic signal through sound localization and generating output signals;

setting, by a coefficient setter, for the one or more filter processors, a plurality of filter coefficients for use in the one or more filter processors;

selecting, by a data selection processor, out of the output signals subjected to the sound localization processing by the one or more filter processors, an output signal to be output to a speaker;

monitoring, by a time measurer, a time for switching the output signals; and causing, by a controller, the data selection processor to select the output signal in accordance with the time for switching the output signals, wherein the plurality of filter coefficients include filter coefficients generated under a plurality of hearing conditions, the plurality of hearing conditions corresponding to a plurality of different hearing positions, respectively.

11. The signal processing method according to claim 10, further comprising:

obtaining auxiliary information; and analyzing, by an auxiliary information analyzer, the auxiliary information, and selecting a coefficient range of the plurality of filter coefficients.

12. The signal processing method according to claim 10, further comprising:

detecting, by an acoustic signal analyzer, a power of the input acoustic signal, wherein in the causing, the controller causes the data selection processor to select the output signal based on the power detected of the input acoustic signal.

* * * * *